US009052113B1

(12) United States Patent
Simmons et al.

(10) Patent No.: US 9,052,113 B1
(45) Date of Patent: Jun. 9, 2015

(54) COMBUSTOR NOZZLE AND METHOD FOR MODIFYING THE COMBUSTOR NOZZLE

(75) Inventors: Scott Robert Simmons, Simpsonville, SC (US); Patrick Benedict Melton, Horse Shoe, NC (US); Russell DeForest, Simpsonville, SC (US); Donald Mark Bailey, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 407 days.

(21) Appl. No.: 13/153,499

(22) Filed: Jun. 6, 2011

(51) Int. Cl.
*F23R 3/28* (2006.01)

(52) U.S. Cl.
CPC .. *F23R 3/283* (2013.01); *F23R 3/28* (2013.01)

(58) Field of Classification Search
CPC .. B05B 1/14; F02M 61/1806; F02M 61/1846; F02M 61/1853; F23R 3/283; F23R 2900/00005
USPC ..... 239/548, 596; 29/557; 219/68, 69.11, 219/69.14–69.17, 76.13
See application file for complete search history.

(56) References Cited

U.S. PATENT DOCUMENTS

| | | | | |
|---|---|---|---|---|
| 5,303,554 | A | 4/1994 | Faulkner | |
| 6,823,677 | B2 | 11/2004 | Prociw et al. | |
| 7,028,622 | B2 | 4/2006 | Taylor | |
| 8,484,978 | B2 | 7/2013 | Bailey et al. | |
| 8,763,359 | B2 | 7/2014 | Romoser | |
| 2004/0079083 | A1 | 4/2004 | Stumpf et al. | |
| 2007/0221759 | A1 * | 9/2007 | Weyandt et al. | 239/548 |
| 2008/0271457 | A1 | 11/2008 | McMasters et al. | |
| 2009/0169394 | A1 * | 7/2009 | Crow et al. | 416/96 R |
| 2009/0200403 | A1 * | 8/2009 | Hung et al. | 239/533.12 |
| 2010/0064690 | A1 * | 3/2010 | Bailey et al. | 60/734 |
| 2010/0300106 | A1 | 12/2010 | Edwards et al. | |

FOREIGN PATENT DOCUMENTS

| | | | |
|---|---|---|---|
| CN | 1101113 | A | 4/1995 |
| CN | 1802536 | A | 7/2006 |
| CN | 101368739 | A | 2/2009 |
| CN | 102061998 | A | 5/2011 |
| EP | 1394470 | A2 | 3/2004 |
| WO | 2013125972 | A1 | 8/2013 |

OTHER PUBLICATIONS

EP Search Report issued on Mar. 24, 2015 in connection with corresponding EP application 12171075.0.

* cited by examiner

*Primary Examiner* — Len Tran
*Assistant Examiner* — Viet Le
(74) *Attorney, Agent, or Firm* — Dority & Manning, P.A.

(57) ABSTRACT

A combustor nozzle includes a downstream surface having an axial centerline. A plurality of passages through the downstream surface provide fluid communication through the downstream surface, and a downstream section of each passage has at least one of a frusto-conical or frusto-spherical shape. A method for modifying a combustor nozzle includes machining a downstream side of a body to remove a recast surface in a plurality of passages that provide fluid communication through the body. The method may further include machining a downstream section in each passage to form at least one of a frusto-conical or frusto-spherical surface in each passage proximate to the downstream side of the body.

14 Claims, 10 Drawing Sheets

COMBUSTOR NOZZLE AND METHOD FOR MODIFYING THE COMBUSTOR NOZZLE

FIELD OF THE INVENTION

The present invention generally involves a combustor nozzle and a method for modifying the combustor nozzle. In particular, various embodiments of the present invention provide a combustor nozzle having one or more passages with a frusto-conical or frusto-spherical surface that enhances cracking fatigue resistance of the combustor nozzle.

BACKGROUND OF THE INVENTION

Combustors are commonly used to ignite fuel to produce combustion gases having a high temperature and pressure. Combustor nozzles typically include a body or a downstream surface at a nozzle tip, and a working fluid and/or fuel is supplied through the nozzle tip to a combustion chamber where the combustion occurs. The temperature difference between the working fluid and fuel on one side of the nozzle tip and the combustion gases on the other side of the nozzle tip creates a substantial thermal gradient across the nozzle tip that may produce cracking or premature failure in the nozzle tip. As a result, the nozzle tip is often forged from metal alloys and may also be coated with a thermal barrier coating to enhance fatigue resistance to cracking Alternately or in addition, cooling holes or passages may be formed through the nozzle tip to allow a portion of the working fluid and/or fuel to pass through the nozzle tip to cool the downstream surface and reduce the temperature difference across the nozzle tip.

The holes or passages may be machined into the nozzle tip using various methods known in the art. For example, electron discharge machining (EDM) may be used to melt the forged metal alloy to create the holes or passages. However, the high temperatures associated with the EDM process leaves a recast layer inside the holes or passages, and the recast layer is typically substantially less resistant to fatigue cracking than the original forged metal alloy. In addition, holes and passages that are angled with respect to an axial centerline of the nozzle tip to enhance cooling to the nozzle tip may result in unsupported portions of the nozzle tip that are more susceptible to fatigue cracking. Although in many cases, the additional cracking caused by the recast layer and/or unsupported portions is merely cosmetic, severe cracking may lead to material loss from the nozzle tip and possible downstream damage. Therefore, an improved combustor nozzle and/or method for modifying the combustor nozzle that enhances resistance to fatigue cracking would be useful.

BRIEF DESCRIPTION OF THE INVENTION

Aspects and advantages of the invention are set forth below in the following description, or may be obvious from the description, or may be learned through practice of the invention.

One embodiment of the present invention is a combustor nozzle that includes a downstream surface having an axial centerline. A plurality of passages extending through the downstream surface provide fluid communication through the downstream surface. A downstream section of each passage has at least one of a frusto-conical or frusto-spherical shape.

Another embodiment of the present invention is a combustor nozzle that includes a body having an upstream side and a downstream side. A plurality of passages extending through the body provide fluid communication from the upstream side to the downstream side. At least one of a frusto-conical or frusto-spherical surface in each passage is proximate to the downstream side of the body.

The present invention may also include a method for modifying a combustor nozzle that includes machining a downstream side of a body to remove a recast surface in a plurality of passages that provide fluid communication through the body. The method may further include machining a downstream section in each passage to form at least one of a frusto-conical or frusto-spherical surface in each passage proximate to the downstream side of the body.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
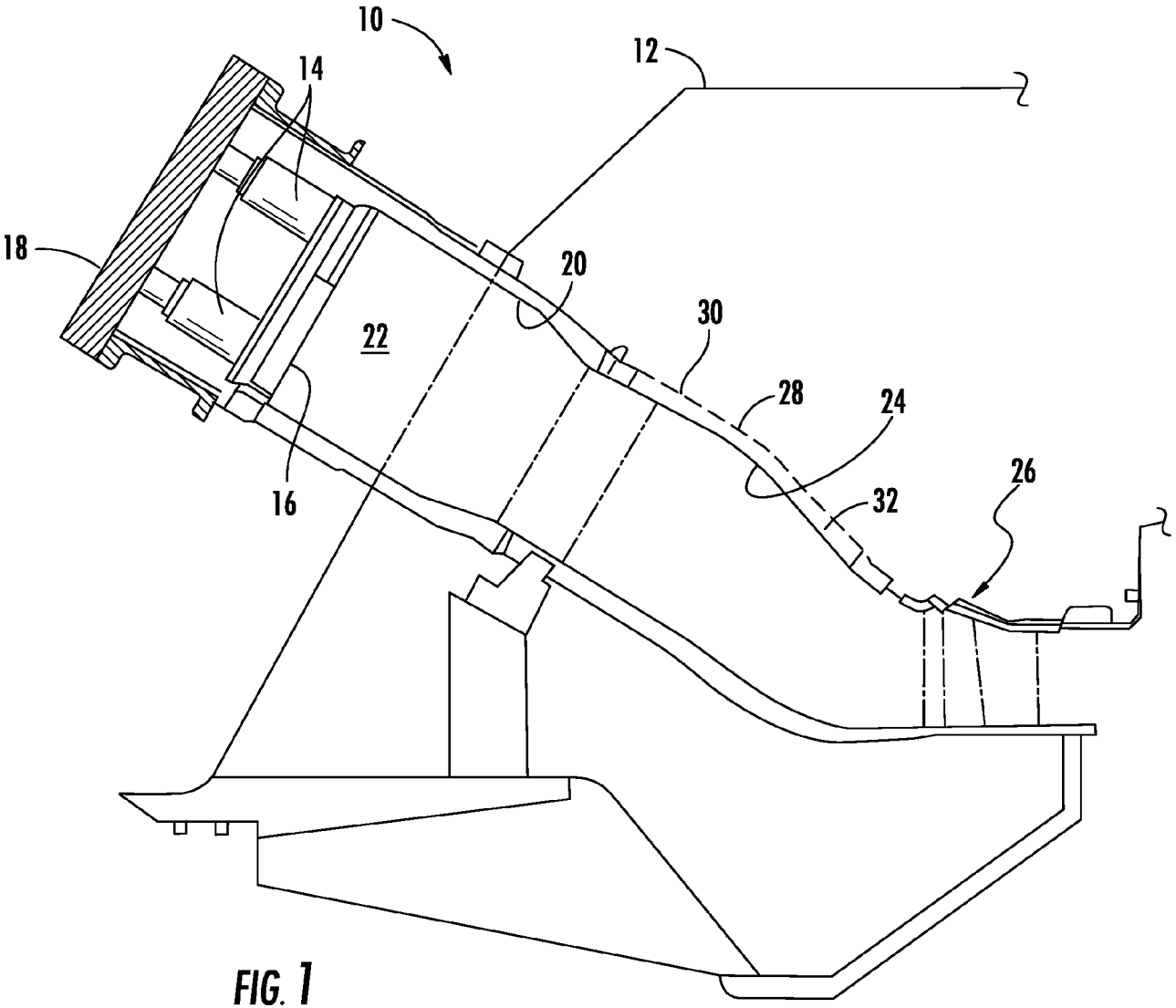
FIG. 1 is a simplified cross-section view of an exemplary combustor.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention provide a combustor nozzle and a method for modifying the combustor nozzle that enhances resistance to fatigue cracking of the nozzle. The enhanced resistance to fatigue cracking of the combustor nozzle may be achieved by one or more features or characteristics of the various embodiments of the present invention. For example, the combustor nozzle may include a plurality of passages through a body or a downstream surface, and each passage may include a frusto-conical or frusto-spherical surface or downstream section. The frusto-conical or frusto-spherical surface or downstream section may reduce or avoid unsupported portions of the body or downstream surface. In particular embodiments, the frusto-conical or frusto-spherical surface or downstream section may replace a previously existing recast surface in each passage that further enhances the fatigue resistance to cracking. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

FIG. 1 shows a simplified cross-section view of an exemplary combustor 10, such as would be included in a gas turbine. A casing 12 may surround the combustor 10 to contain the compressed working fluid flowing to the combustor 10. As shown, the combustor 10 may include one or more nozzles 14 radially arranged between a cap 16 and an end cover 18. Various embodiments of the combustor 10 may include different numbers and arrangements of nozzles 14. The cap 16 and a liner 20 generally surround and define a combustion chamber 22 located downstream from the nozzles 14, and a transition piece 24 downstream from the liner 20 connects the combustion chamber 22 to a turbine inlet 26. As used herein, the terms "upstream" and "downstream" refer to the relative location of components in a fluid pathway. For example, component A is upstream from component B if a fluid flows from component A to component B. Conversely, component B is downstream from component A if component B receives a fluid flow from component A.

An impingement sleeve 28 with flow holes 30 may surround the transition piece 24 to define an annular passage 32 between the impingement sleeve 28 and the transition piece 24. The compressed working fluid may pass through the flow holes 30 in the impingement sleeve 28 to flow through the annular passage 32 to provide convective cooling to the transition piece 24 and liner 20. When the compressed working fluid reaches the end cover 18, the compressed working fluid reverses direction to flow through the one or more nozzles 14 where it mixes with fuel before igniting in the combustion chamber 22 to produce combustion gases having a high temperature and pressure.

Figure 2:
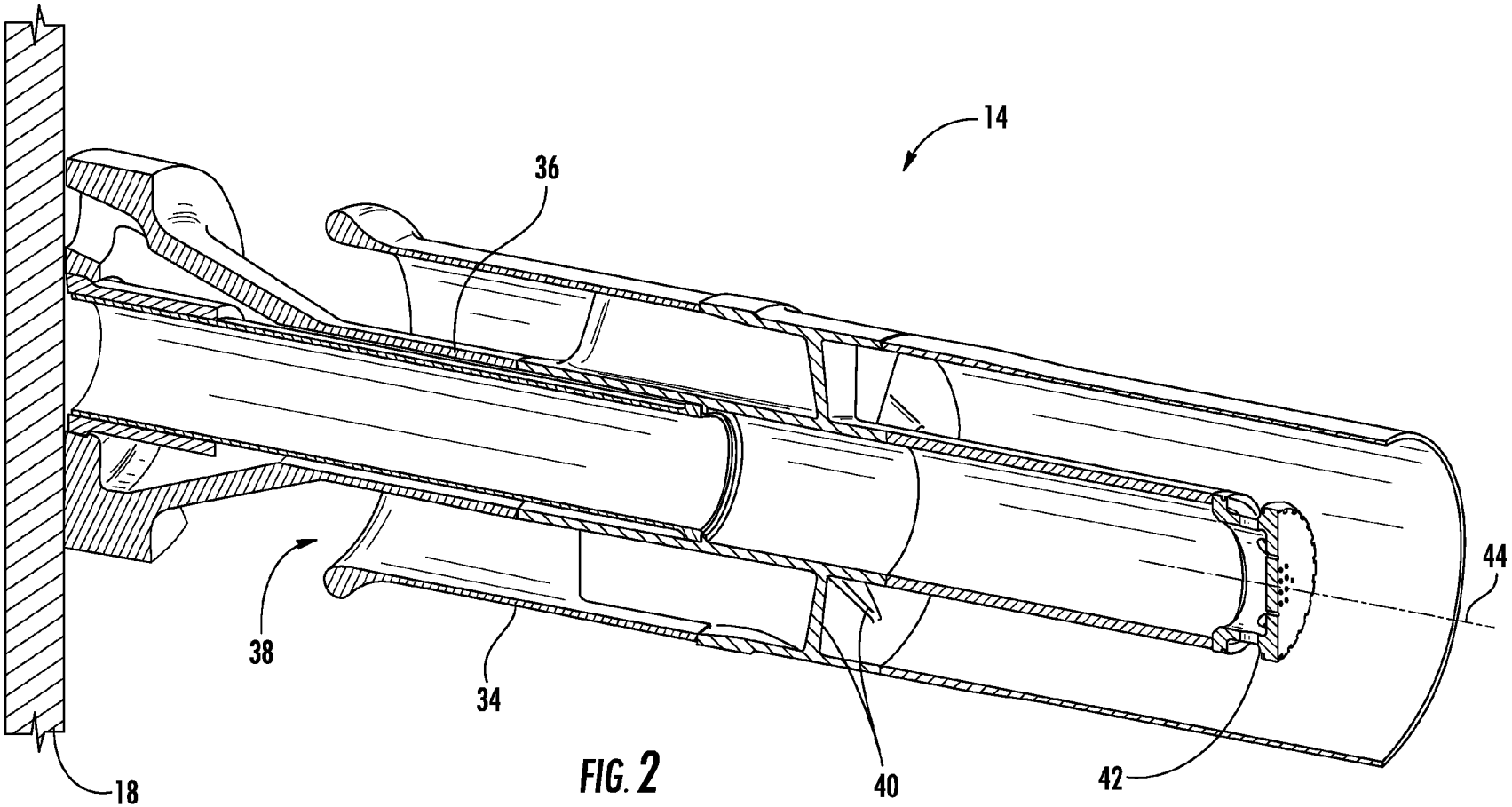
FIG. 2 is a cross-sectional perspective view of an exemplary combustor nozzle shown in FIG. 1.

FIG. 2 provides a cross-sectional perspective view of an exemplary nozzle 14 shown in FIG. 1. As shown, the nozzle 14 may comprise a shroud 34 that circumferentially surrounds at least a portion of a center body 36 to define an annular passage 38 between the shroud 34 and the center body 36. At least a portion of the working fluid may enter the nozzle 14 through the annular passage 38, and one or more swirler vanes 40 between the shroud 34 and the center body 36 may impart a tangential velocity to the compressed working fluid flowing through the nozzle 14. The center body 36 may extend axially from the end cover 18 to a nozzle tip 42, and the nozzle tip 42 may be axially aligned with or parallel to an axial centerline 44 of the nozzle 14. In this manner, the center body 36 provides fluid communication from the end cover 18, through the center body 36, and out of the nozzle tip 42.

Figure 3:
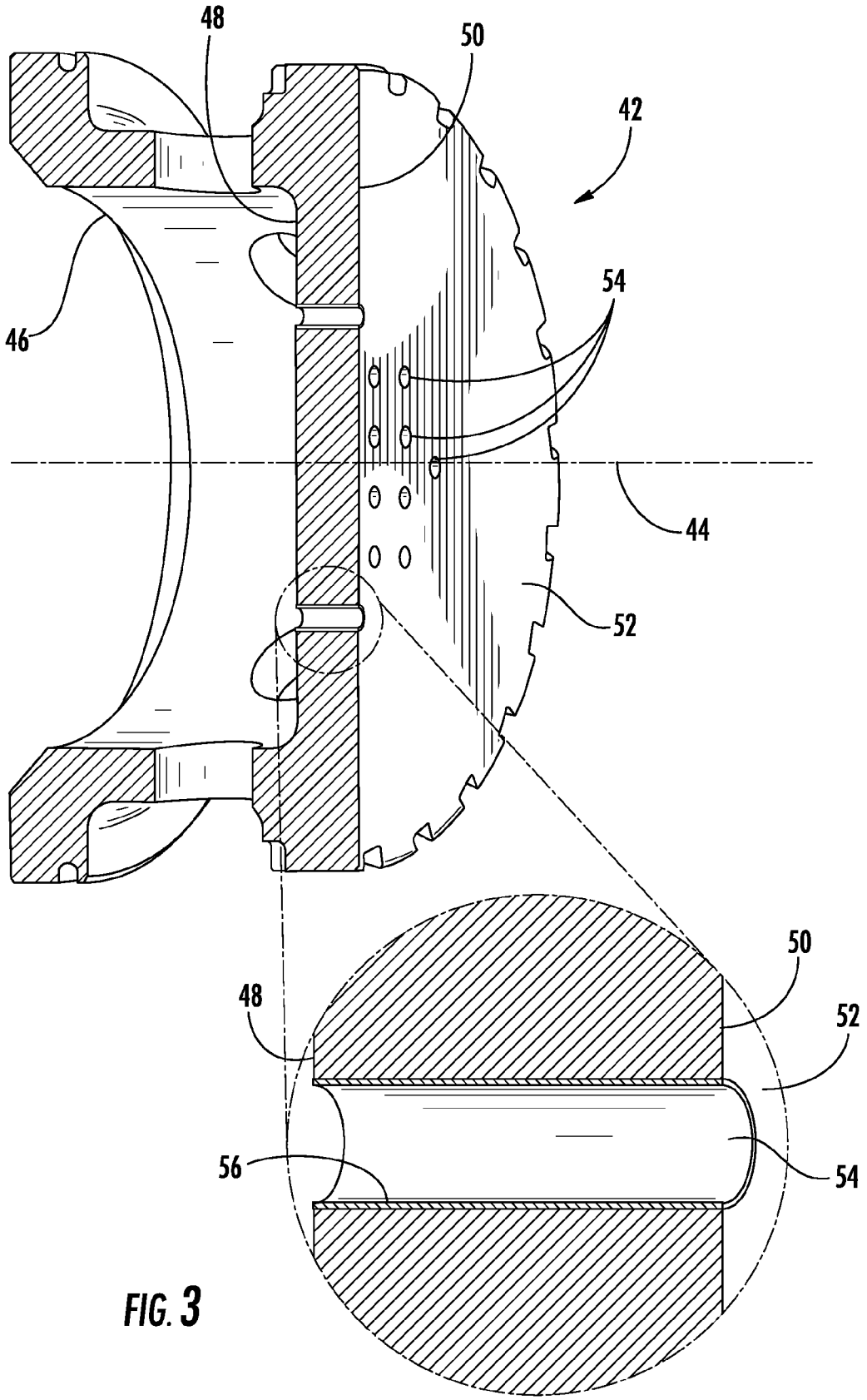
FIG. 3 is an enlarged perspective cross-section view of an exemplary nozzle tip shown in FIG. 2.

FIG. 3 provides an enlarged perspective cross-section view of an exemplary nozzle tip 42 shown in FIG. 2. As shown, the nozzle tip 42 generally comprises a body 46 having an upstream side 48, a downstream side 50, and a downstream surface 52. The body 46 and/or downstream surface 52 may be cast, forged, or sintered from a metal alloy or powdered metal allow to enhance the fatigue resistance of the nozzle tip 42 proximate to the combustion chamber 22. The nozzle tip 42 may further include a plurality of holes or passages 54 extending through the body 46 and/or downstream surface 52. As shown in the particular embodiment illustrated in FIG. 3, the holes or passages 54 may be aligned substantially parallel to the axial centerline 44 and provide fluid communication from the upstream side 48 to the downstream side 50 or through the body 46 and/or downstream surface 52. In this manner, the passages 54 allow a fluid, such as a fuel, an oxidant, or a diluent, to flow through the body 46 and/or downstream surface 52 to cool the body 46, the downstream side 50 of the body 46, and/or downstream surface 52.

The holes or passages 54 may be machined into the nozzle tip 42 using various methods known in the art. For example, electron discharge machining (EDM) may be used to melt the forged metal alloy to create the holes or passages 54. However, as shown in FIG. 3, the high temperatures associated with the EDM process leaves a recast layer or surface 56 inside the holes or passages 54, and the recast surface 56 is typically substantially less resistant to fatigue cracking than the original forged metal alloy.

Figure 4:
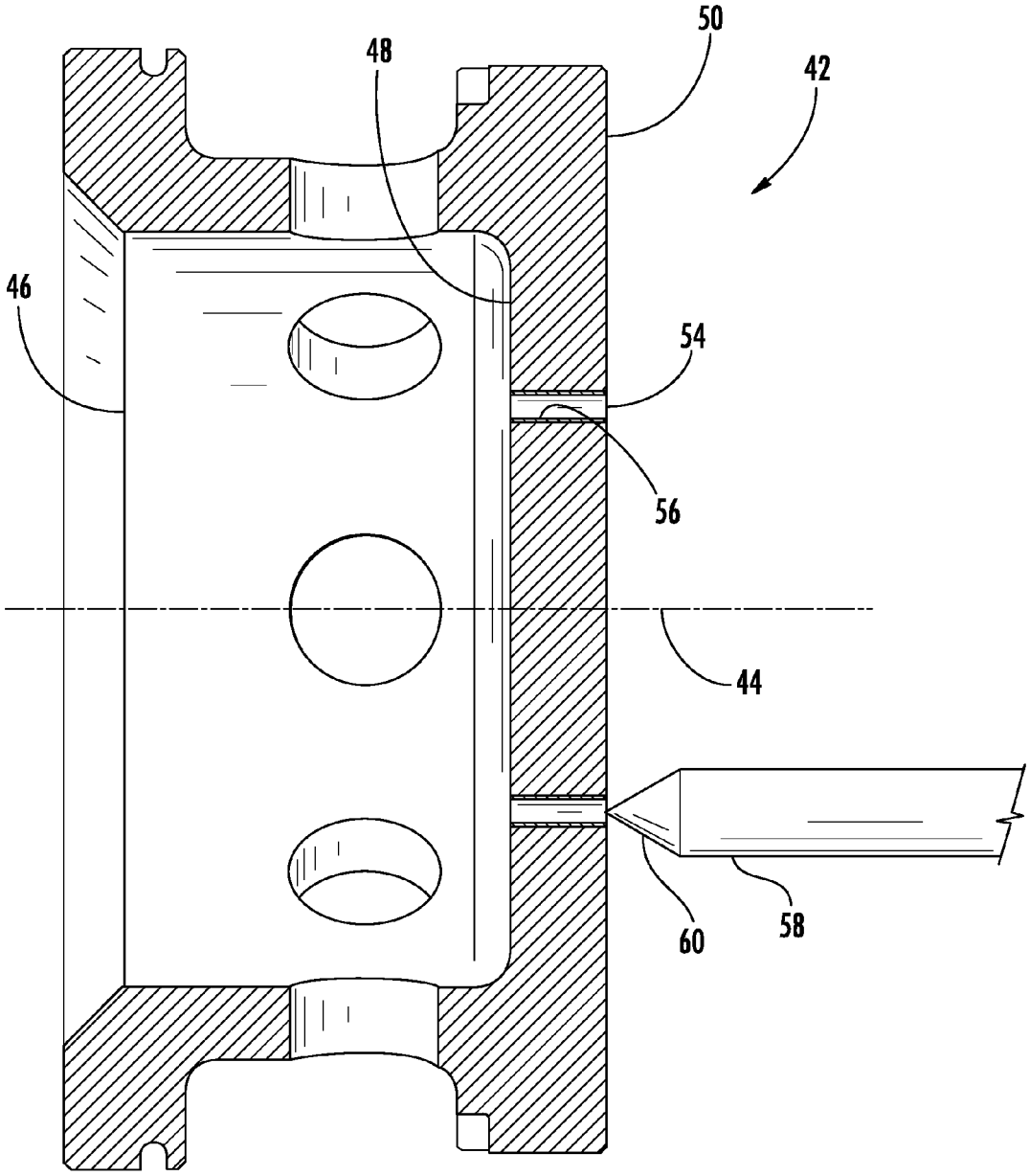
FIG. 4 is a side plan view of the exemplary nozzle tip shown in FIG. 3 being modified according to a first embodiment of the present invention.
Figure 5:
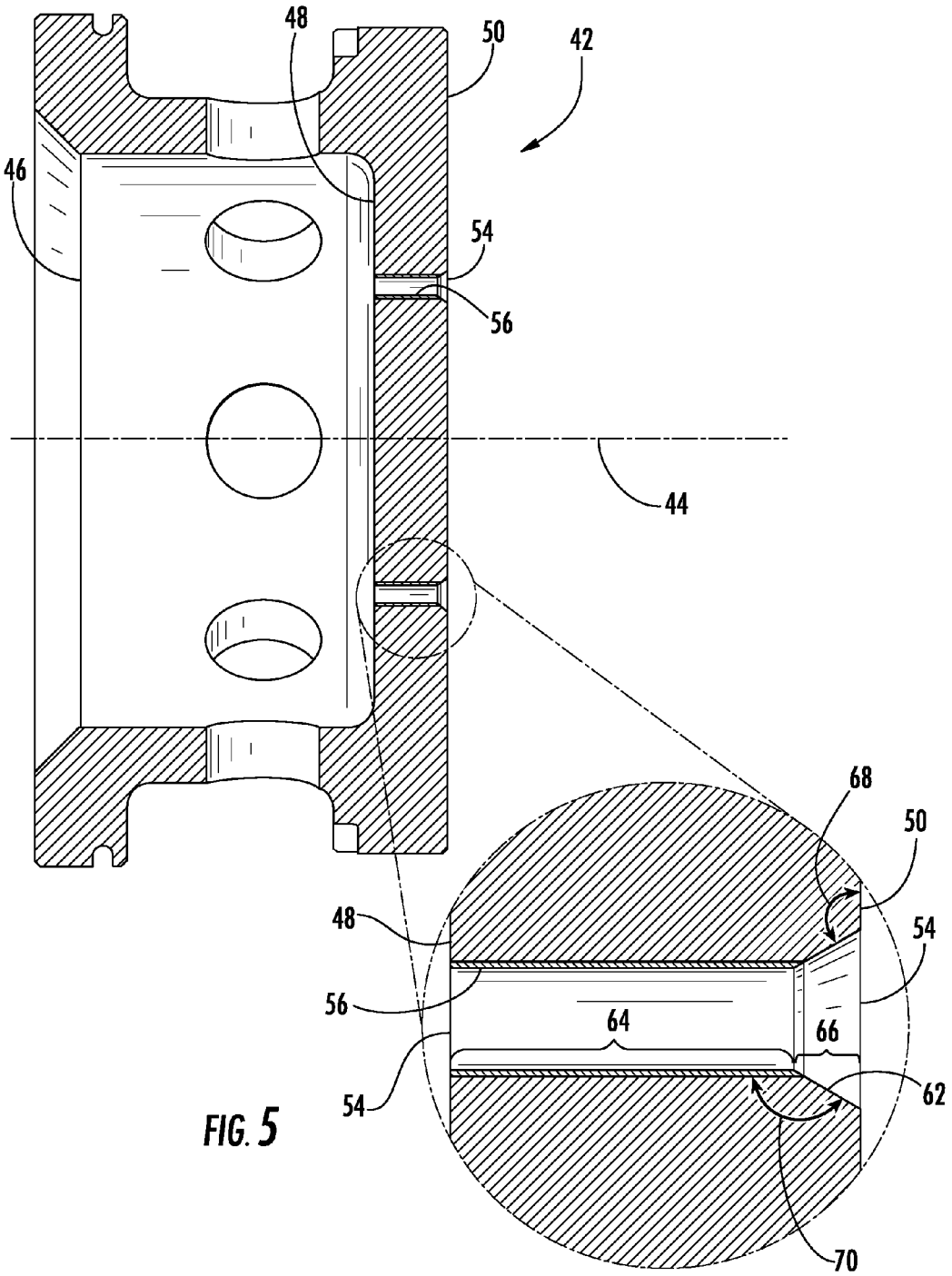
FIG. 5 is a side plan view of the exemplary nozzle tip shown in FIG. 4 modified according to the first embodiment of the present invention.

FIGS. 4 and 5 provide side plan views of the exemplary nozzle tip 42 shown in FIG. 3 being modified according to a first embodiment of the present invention. As shown, a machine such as a drill or mill may be positioned above the body 46 and precisely aligned with one or more of the passages 54. A drill bit 58 or other milling surface may then be inserted into the passage 54 to remove at least a portion of the downstream surface 52 and interior wall of the passage 54. The drill bit 58 may comprise, for example, a frusto-conical shape 60 to produce a corresponding or complementary frusto-conical shape or surface 62 inside each passage 54 proximate to the downstream side 50 of the body 46. As shown in FIG. 5, the resulting passage 54 comprises an upstream section 64 and a downstream section 66, with the fatigue susceptible recast surface 56 removed from the downstream section 66 but still remaining in the upstream section 64.

In the particular embodiment shown in FIGS. 4 and 5, the drill bit 58 was inserted into the passage 54 substantially parallel to the axial centerline 44 so that the longitudinal axis of the drill bit 58 is substantially parallel to and coincides with the longitudinal axis of the passage 54. As a result, each resulting passage 54, including the downstream section 66, is generally symmetrical. As further shown in FIG. 5, each downstream section 66 forms an angle 68 with the downstream side or surface 50, 52, and the angle 68 between the downstream section 66 and the downstream side or surface 50, 52 is greater than or equal to approximately 90 degrees. Similarly, each downstream section 66 forms an angle 70 with the upstream section 64, and the angle 70 between the downstream section 66 and the upstream section 64 is greater than or equal to approximately 90 degrees. The angles 68, 70 between the downstream section 66 and the downstream side or surface 50, 52 and/or the upstream section 64 reduce fatigue cracking by providing additional support to the downstream side or surface 50, 52 and/or upstream section 64, respectively.

Figure 6:
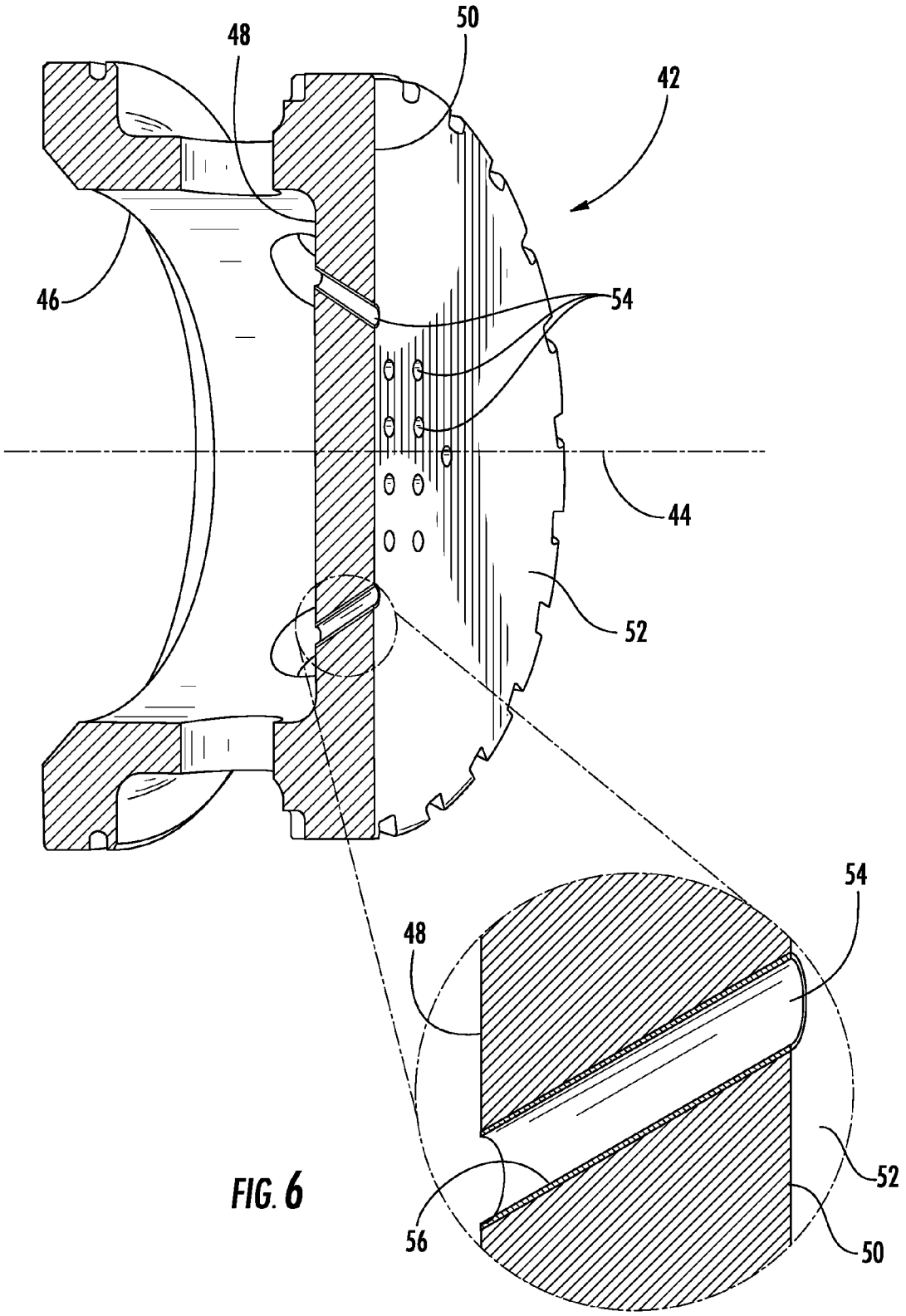
FIG. 6 is an enlarged perspective cross-section view of an exemplary nozzle tip shown in FIG. 2.

FIG. 6 provides an enlarged perspective cross-section view of another exemplary nozzle tip 42 shown in FIG. 2. As shown, the nozzle tip 42 again generally comprises a body 46, an upstream side 48, a downstream side 50, a downstream surface 52, a plurality passages 54, and a recast surface 56 as previously described with respect to the nozzle tip 42 shown in FIGS. 3-5. In the particular embodiment illustrated in FIG. 6, the passages 54 are angled radially and/or circumferentially with respect to the axial centerline 44 to enhance cooling to the downstream side or surface 50, 52 by swirling the fluid flowing through the passages 54.

Figure 7:
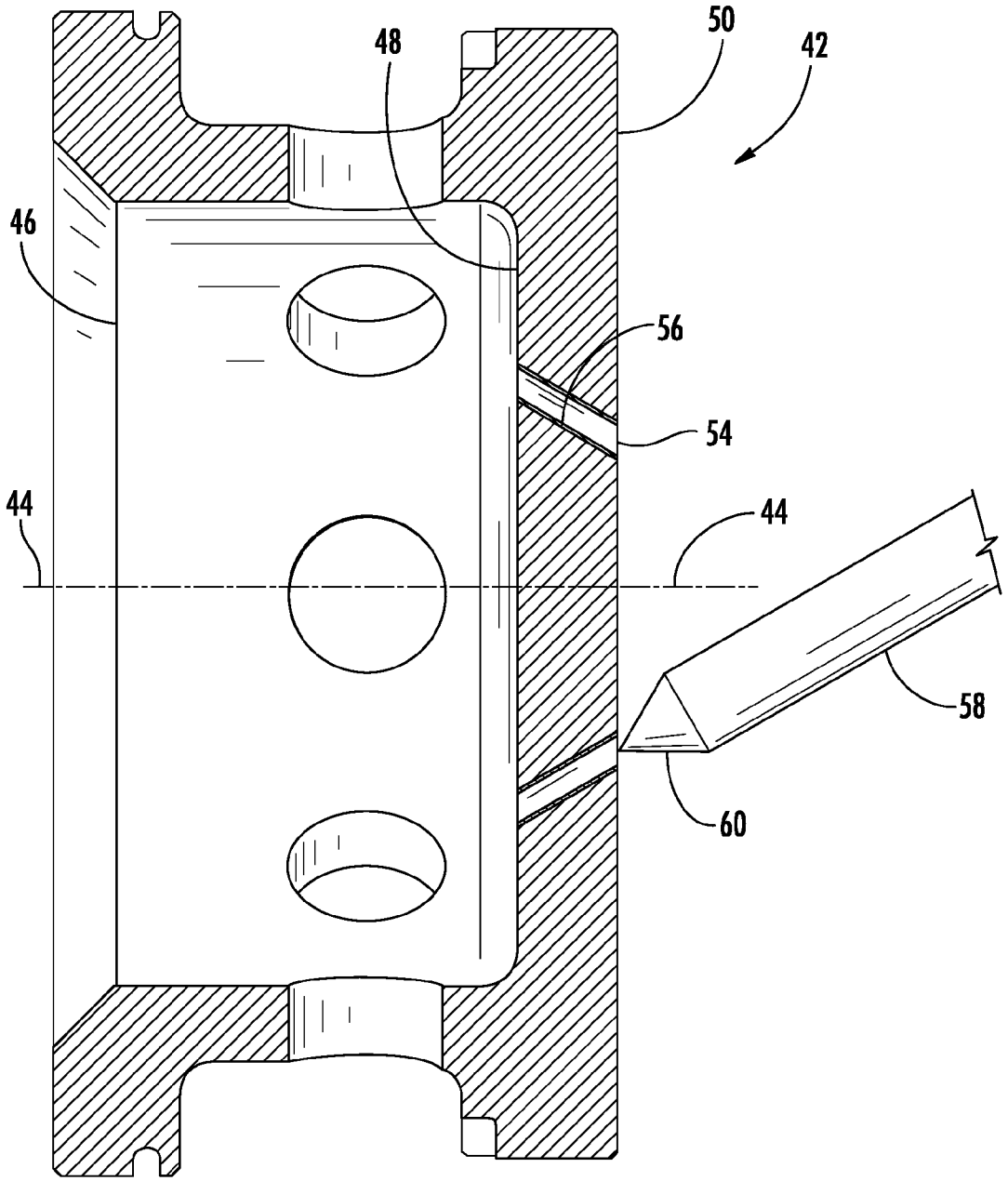
FIG. 7 is a side plan view of the exemplary nozzle tip shown in FIG. 6 being modified according to a second embodiment of the present invention.
Figure 8:
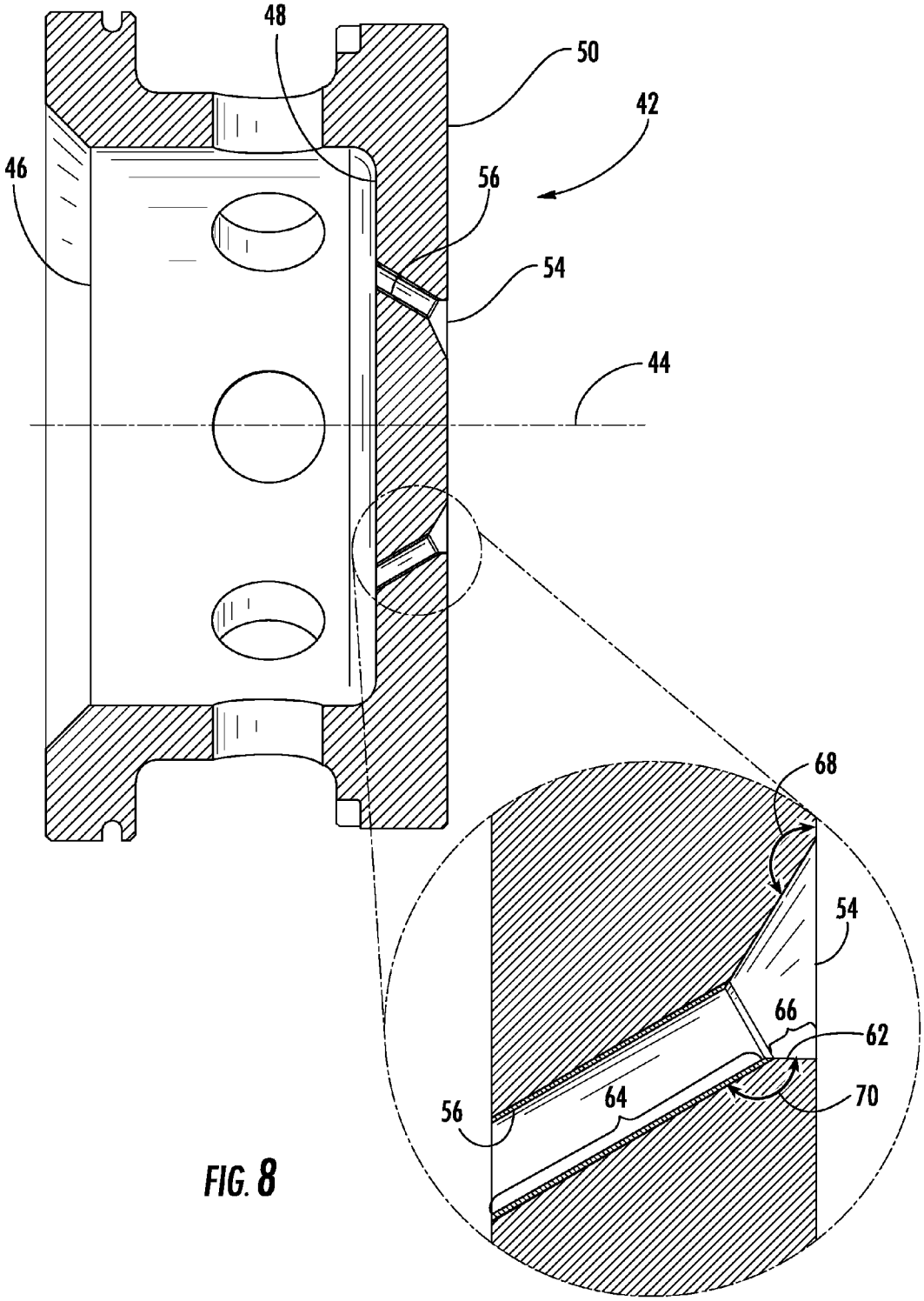
FIG. 8 is a side plan view of the exemplary nozzle tip shown in FIG. 6 modified according to the second embodiment of the present invention.

FIGS. 7 and 8 provide side plan views of the exemplary nozzle tip 42 shown in FIG. 6 being modified according to a second embodiment of the present invention. As shown, a machine such as a drill or mill may again be positioned above the body 46, and the drill bit 58 or other milling surface may be inserted into the passage 54 to remove at least a portion of the downstream surface 52 and interior wall of the passage 54. The frusto-conical shape 60 of the drill bit 58 again produces the corresponding or complementary frusto-conical shape or surface 62 inside each passage 54 proximate to the downstream side 50 of the body 46. As shown in FIG. 8, the fatigue susceptible recast surface 56 has again been removed from the downstream section 66 but still remains in the upstream section 64.

In the particular embodiment shown in FIGS. 7 and 8, the drill bit 58 was inserted into the passage 54 at an angle with respect to the axial centerline 44 so that the longitudinal axis of the drill bit 58 is again substantially parallel to and coincides with the longitudinal axis of the passage 54. As a result, each resulting passage 54, including the downstream section 66, is generally asymmetrical. Specifically, as shown in FIG. 8, the angle 68 between the downstream section 66 and the downstream side or surface 50, 52 is approximately 90 degrees around a portion of the downstream section 66 and an obtuse angle around the remainder of the downstream section 66.

Figure 9:
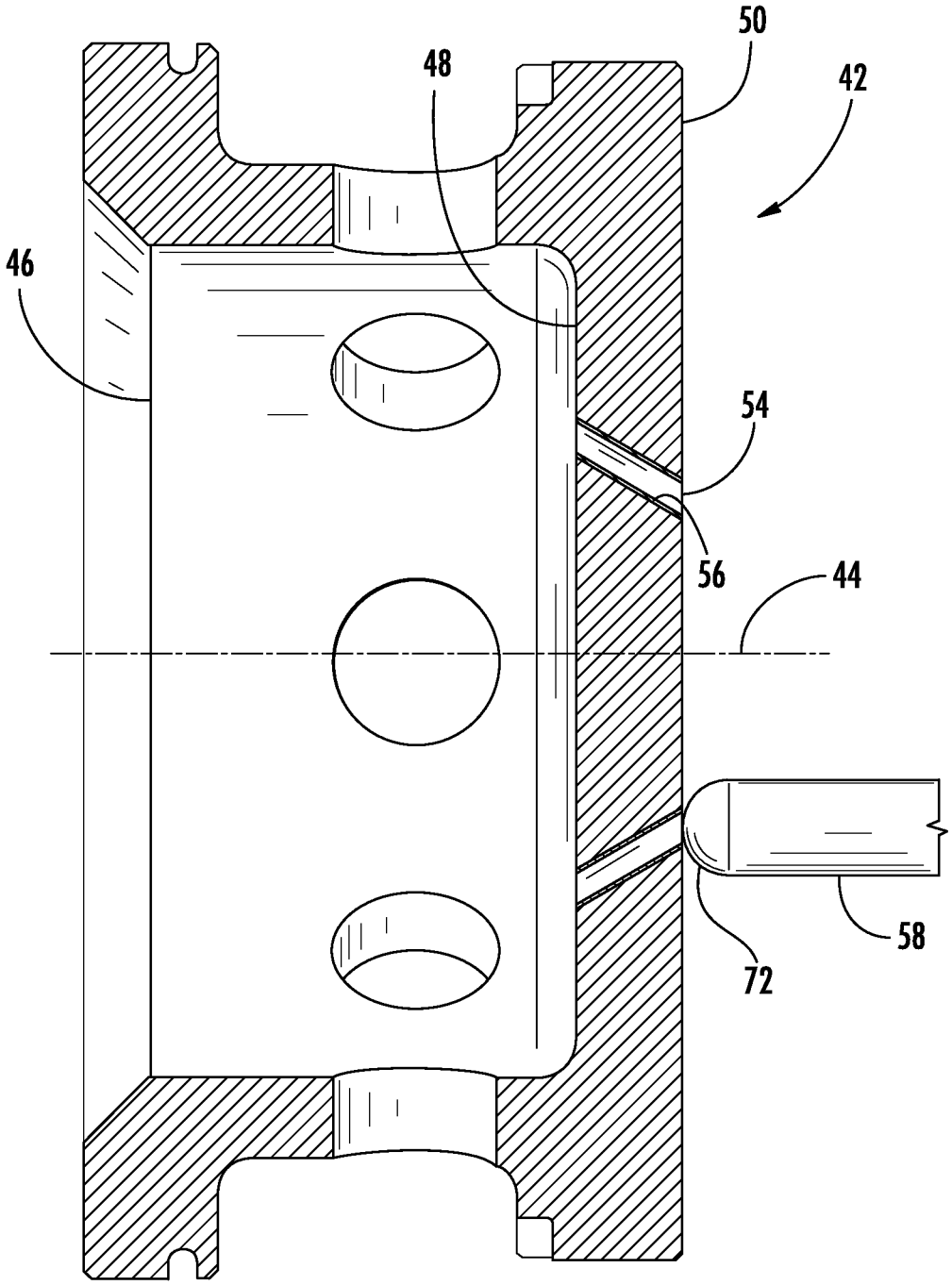
FIG. 9 is a side plan view of the exemplary nozzle tip shown in FIG. 6 being modified according to a third embodiment of the present invention.
Figure 10:
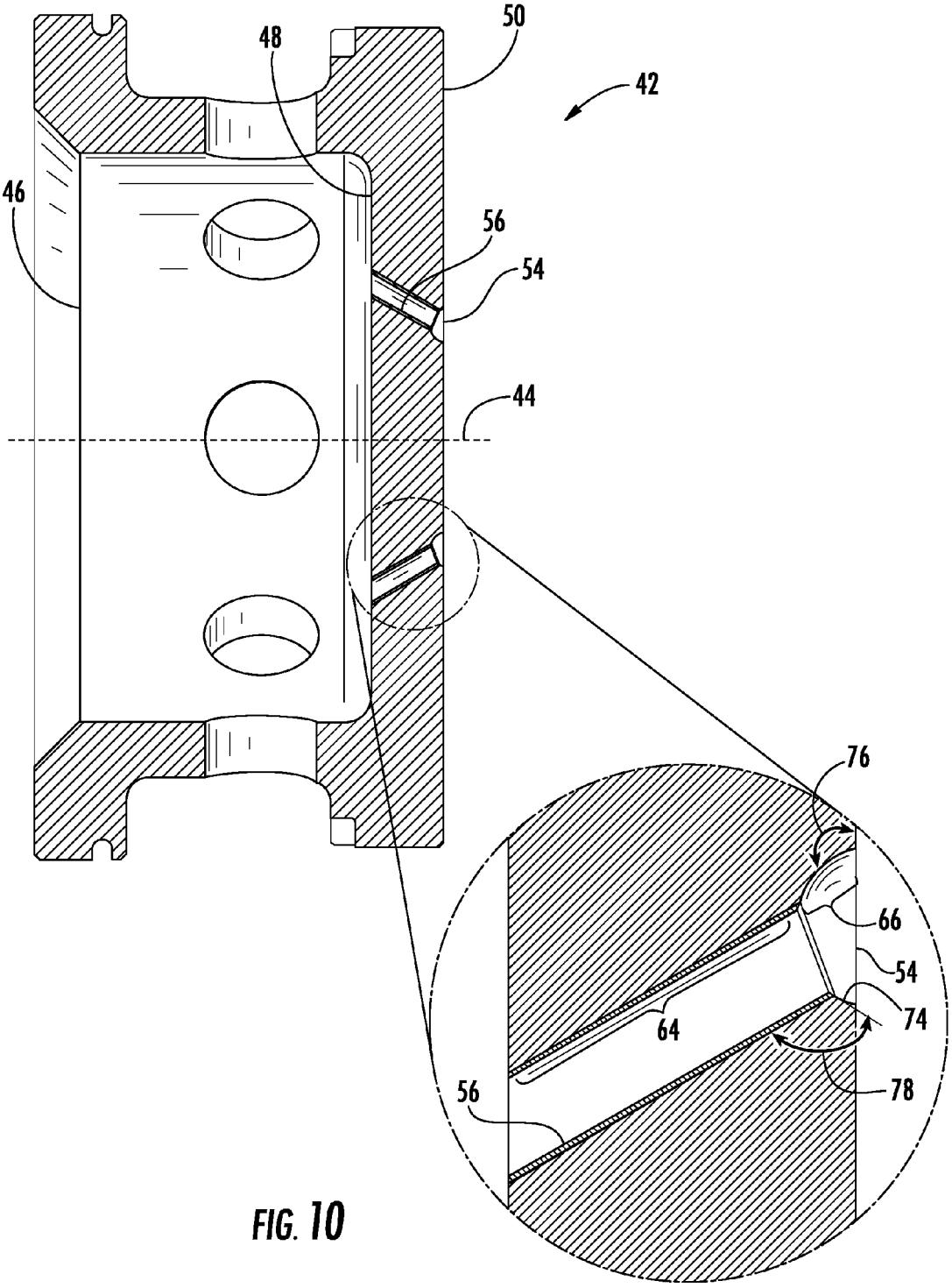
FIG. 10 is a side plan view of the exemplary nozzle tip shown in FIG. 6 modified according to the third embodiment of the present invention.

FIGS. 9 and 10 provide side plan views of the exemplary nozzle tip 42 shown in FIG. 6 being modified according to a third embodiment of the present invention. In this particular embodiment, the drill bit 58 may comprise a ball-nosed or frusto-spherical shape 72 to produce a corresponding or complementary frusto-spherical shape or surface 74 inside each passage 54 proximate to the downstream side 50 of the body 46. The frusto-spherical shape 72 of the drill bit 58 allows the drill bit 58 to be inserted into the passage 54 substantially parallel to the axial centerline 44 or perpendicular to the downstream side 50 without removing excessive amounts of material on one side of the passage 54 and while still avoiding forming an acute angle between the frusto-spherical surface 74 and the downstream side 50. Specifically, the frusto-spherical shape or surface 74 forms an angle 76 with the downstream side or surface 50, 52 that is approximately 90 degrees around a portion of the downstream section 66 and an obtuse angle around the remainder of the downstream section 66. In addition, the frusto-spherical shape or surface 74 forms an angle 78 with the upstream section 64 that is greater than or equal to approximately 90 degrees.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A combustor nozzle, comprising:

a shroud;

a center body at least partially disposed within the shroud such that a passage is defined between the center body and the shroud; and a nozzle tip disposed at a downstream end of the center body, the nozzle tip comprising:

a downstream surface having an axial centerline;

a plurality of passages extending through the downstream surface, wherein the plurality of passages provide fluid communication through the downstream surface, each passage comprising an upstream section and a downstream section that define the passage; and a recast surface in the upstream section of each passage, wherein the recast surface is a melted and re-formed portion of the upstream section, the upstream section and recast surface formed from the same material, wherein the downstream section of each passage is free from recast surfaces, and wherein each downstream section has at least one of a frusto-conical or frusto-spherical shape.

2. The combustor nozzle as in claim 1, wherein each passage is aligned substantially parallel to the axial centerline of the downstream surface.

3. The combustor nozzle as in claim 1, wherein the downstream section of each passage is symmetrical.

4. The combustor nozzle as in claim 1, wherein the downstream section of each passage is asymmetrical.

5. The combustor nozzle as in claim 1, wherein each downstream section forms an angle with the downstream surface, and the angle between the downstream section and the downstream surface is greater than or equal to approximately 90 degrees.

6. The combustor nozzle as in claim 1, wherein each downstream section forms an angle with the downstream surface, and the angle between the downstream section and the downstream surface is obtuse around at least a portion of each downstream section.

7. The combustor nozzle as in claim 1, wherein in each passage, the downstream section forms an angle with the upstream section, and the angle between the downstream section and the upstream section is greater than or equal to approximately 90 degrees.

8. A combustor nozzle, comprising:

a shroud;

a center body at least partially disposed within the shroud such that a passage is defined between the center body and the shroud; and a nozzle tip disposed at a downstream end of the center body, the nozzle tip comprising:

a body having an upstream side and a downstream side;

a plurality of passages extending through the body, wherein the plurality of passages provide fluid communication from the upstream side to the downstream side;

a recast surface in an upstream section of each passage, wherein the recast surface is a melted and re-formed portion of the upstream section, the upstream section and recast surface formed from the same material; and at least one of a frusto-conical or frusto-spherical surface in each passage proximate to the downstream side of the body, wherein the downstream section of each passage is free from recast surfaces.

9. The combustor nozzle as in claim 8, wherein the plurality of passages are aligned parallel to an axial centerline of the body.

10. The combustor nozzle as in claim 8, wherein each passage is symmetrical.

11. The combustor nozzle as in claim 8, wherein each passage is asymmetrical.

12. The combustor nozzle as in claim 8, wherein each frusto-conical or frusto-spherical surface forms an angle with the downstream side that is greater than or equal to approximately 90 degrees.

13. The combustor nozzle as in claim 8, wherein each frusto-conical or frusto-spherical surface forms an angle with the downstream side that is obtuse around at least a portion of the frusto-conical or frusto-spherical surface.

14. The combustor nozzle as in claim 8, wherein in each passage, the upstream section forms an angle with the frusto-conical or frusto-spherical surface, and the angle is greater than or equal to approximately 90 degrees.

* * * * *